United States Patent [19]

Leonard

[11] Patent Number: 4,685,285

[45] Date of Patent: Aug. 11, 1987

[54] PNEUMATICALLY CONTROLLED ANTI-BALLOON DEVICE

[75] Inventor: Robert C. Leonard, Bessemer City, N.C.

[73] Assignee: Jenkins Metal Corporation, Gastonia, N.C.

[21] Appl. No.: 897,420

[22] Filed: Aug. 18, 1986

[51] Int. Cl.[4] ..... D01H 7/18; D01H 1/42

[52] U.S. Cl. ..... 57/356; 57/75; 57/354

[58] Field of Search ..... 57/352, 75, 98, 99, 57/354–357, 359

[56] References Cited

U.S. PATENT DOCUMENTS

| | | | |
|---|---|---|---|
| 1,606,056 | 11/1926 | Butterworth | 57/356 |
| 2,081,416 | 5/1937 | Vicq | 57/354 |
| 2,690,643 | 10/1954 | Vella | 57/356 |
| 2,747,360 | 5/1956 | Vella | 57/356 |
| 2,773,345 | 12/1956 | Leutert | 57/356 |
| 2,865,162 | 12/1958 | Hope | 57/356 |
| 2,949,726 | 8/1960 | Latus | 57/356 |

*Primary Examiner*—John Petrakes

*Attorney, Agent, or Firm*—Clifton Ted Hunt

[57] ABSTRACT

According to the invention, a balloon ring is supported in concentric position about each spindle on a spinning frame by a bracket supported by a mounting rod that is in turn supported on the free ends of air cylinders mounted beside and correspondingly movable with the ring rail. The pistons in the air cylinders are initially extended to support the balloon rings at a first position. That position has been determined to be in an optimum area for control of the yarn balloon during movement of the ring rail through the lower portion of its traversing motion to build the bottom half of the package. As the rail ring begins to move through the upper portion of its traversing movements and the balloon rings approach the yarn transfer guides, a limit or proximity switch is activated to retract the pistons of the air cylinders and uniformly lower the balloon rings to a second or retracted position closer to the ring rail, and positioned to control the balloon while the upper half of the package continues to build. When the package is completed and the machine goes into bear down position, the balloon ring remains retracted to permit doffing of the package.

10 Claims, 9 Drawing Figures

PACKAGE AT TIME BALLOON RING CYLINDER RETRACTS ~ PACKAGE CONTINUES TO BUILD.

MACHINE IN BEAR DOWN POSITION.
PACKAGE TO BE DOFFED.

PNEUMATICALLY CONTROLLED ANTI-BALLOON DEVICE

BACKGROUND OF THE INVENTION

This invention relates to the art of winding yarn on spinning machines, twisting machines and the like, and more specifically to apparatus for controlling the extent of yarn balloons as yarn passes from delivery rolls to bobbins mounted on rotating spindles to be wound thereon and form a package through the medium of a ring and traveler device.

For convenience, the invention will be described as being mounted on a spinning machine, although the term "spinning machine" is to be considered throughout the specification and claims a generic term to include other winding machines, such as twisting machines, doubling machines, and any other machines in which yarn or thread forms a balloon around and in spaced relation to a yarn package as the yarn is directed to or withdrawn from the package.

In the operation of certain types of spinning machines, yarn is directed from a source to each of a plurality of tubes or bobbins mounted on rotating spindles by means of corresponding rings and travelers mounted on a vertically traversing ring rail. The yarn is directed to the traveler through suitable guides spaced above corresponding spindles. The further the ring rail is away from the yarn guide, the greater the ballooning of the yarn. Also, as the ring rail is traversed relative to the packages being built on the spindles, the median point of greatest ballooning of the yarn continually changes. The yarn balloon whirls will strike against any obstruction it encounters such as, for example, balloons produced by adjacent spindles.

It is known in the prior art to place partitions or separators between the spindles so that the balloon of each spindle is, in effect, housed in an enclosure closed on opposed sides and opened at the front, rear, top, and bottom. The ballooning yarn strikes the separators repeatedly during the building of a package and each time the yarn strikes a separator the impact of the yarn against the separator has an abrasive effect on the yarn. The repeated impacts of the yarn against the separators frequently produces knots, slubs, and other imperfections in the yarn.

Various attempts have been made to control or limit the ballooning of the yarn, including rigid balloon guards mounted on, and in fixed relation to, the ring rail, so as to have the guard move in fixed spaced relation to the ring rail as it traverses to build the yarn package. See, for example, Pat. No. 1,606,056 issued Nov. 9, 1926 to Charles A. Butterworth and Pat. No. 2,081,416 issued May 25, 1937 to Jean Charles Albert Vicq.

Balloon guards have also been used which are movable relative to the ring rail throughout a substantial part of the traverse of the ring rail to build the package. See, for example, Pat. No. 2,865,162 issued Dec. 23, 1958 to Orville L Hope and Pat. No. 2,773,345 issued Dec. 11, 1956 to Walter W Leutert. The prior art balloon guards which are movable relative to the ring rail have been unsatisfactory because they have required complicated and expensive supporting and operational devices.

SUMMARY OF THE INVENTION

According to the invention, a balloon ring is supported in concentric position about each spindle on a spinning frame by a bracket supported by a mounting rod that is in turn supported on the free ends of air cylinders mounted beside and correspondingly movable with the ring rail. The air cylinders are spaced sufficiently close together (such as, for example, 2½to 5 feet apart) along the length of the ring rail to support all of the balloon rings in a substantially common plane. The pistons in the air cylinders are initially extended to support the balloon rings at a first position about 30% to 35% of the length of the spindle tube as measured from its base. That position has been determined to be in an optimum area for control of the yarn balloon during movement of the ring rail through the lower portion of its traversing motion to build the bottom half of the package.

As the ring rail begins to move through the upper portion of its traversing movements and the balloon rings approach the yarn transfer guides, a limit or proximity switch is activated to retract the pistons of the air cylinders and uniformly lower the balloon rings to a second or retracted position closer to the ring rail, and positioned to control the balloon while the upper half of the package continues to build. When the package is completed and the machine goes into bear down position, the balloon ring remains retracted to permit doffing of the package.

All of the air cylinders on a frame are simultaneosly operated to provide uniform positioning of the balloon rings at their extended positions while the ring rail moves through the lower portion of its traversing motion and at their retracted positions while the ring rail moves through the upper portion of its traverse.

The air cylinders are connected to limit switches and solenoids which activiate the air cylinders to maintain the balloon rings in areas of maximum balloon control during building of the package. Specifically, as the ring rail rises to begin the upper portion of its traverse, a sensing device is activated to retract the pistons of the air cylinders and lower the balloon rings to an area of maximum balloon control. The package continues to build and the balloon ring moves with the ring rail. When the package is completed and the machine goes into bear down position, the retracted balloon rings permit doffing of the packages.

All of the air cylinders on a frame are simultaneously operated to provide uniform positioning of the balloon ring relative to their respective spindles, thereby providing better quality and increased production.

DETAILED DESCRIPTION OF THE INVENTION

The single spinning station illustrated in FIGS. 1-6 is intended to be representative of all of the spinning stations on a spinning frame equipped with this invention, except that there will not be an air cylinder at each station for reasons of economy. It is an important feature of the invention that all of the balloon rings on the spinning frame are supported at the same height above the ring rail in each of the two operative positions. It is necessary to prevent declination of the balloon rings to accomplish this. This can be accomplished, for example, by using 3 air cylinders on two sections of the frame, wherein each section measures 4 feet (1.22 meters) in length.

Figure 8:
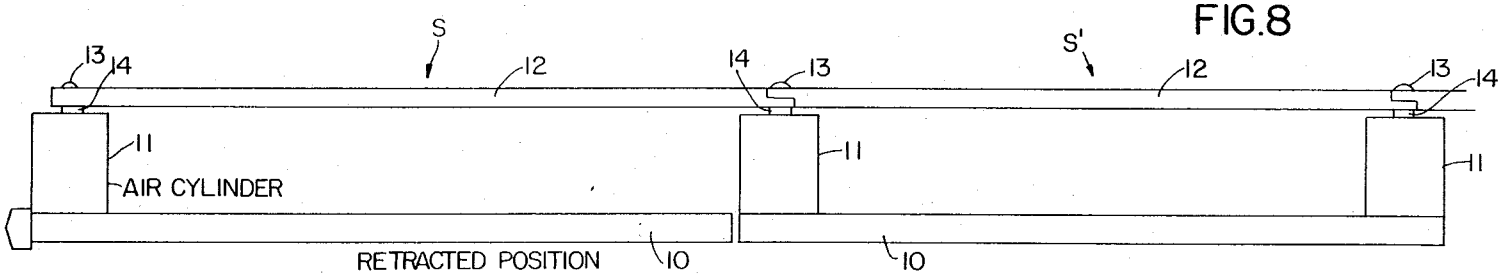
FIG. 8 is a schematic front elevation, with parts broken away, of the air cylinders shown in FIG. 7 with the pistons of the air cylinders retracted to fix the balloon rings relative to the ring rail for optimum control of the balloon during the upper portion of the traverse.
Figure 9:
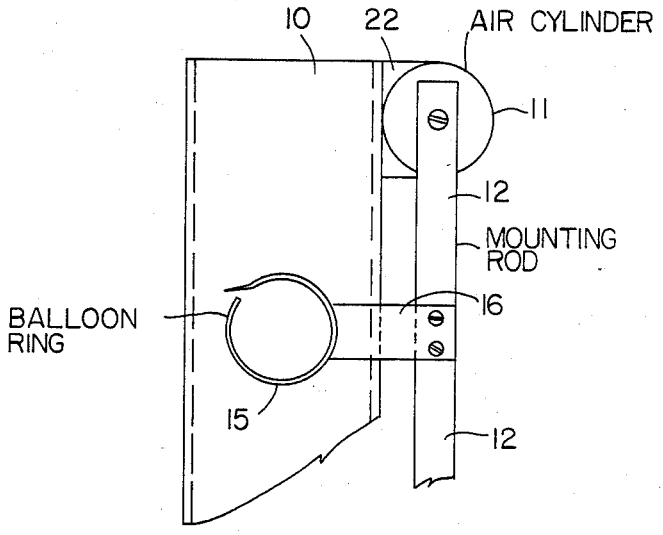
FIG. 9 is a schematic top plan view, with parts broken away, illustraing the positioning of the air cylinder and balloon control ring at a station on a spinning frame.

FIG. 8 shows the ring rails 10 of two sections S and $S^{/}$ of a spinning frame with an air cylinder 11 at the left side of the rail 10 in Section S and with air cylinders 11 at each end of the rail 10 in Section $S^{/}$. Mounting rods 12 connect the free ends 13 of pistons 14 extending from the air cylinders 11. Each mounting rod 12 is of a length sufficient to span the distance between two adjacent cylinders 11, it being noted that both cylinders in section $S^{1}$ in FIG. 8 typically support two mounting rods 12 in overlapping relation on their free ends 13.

Figure 7:
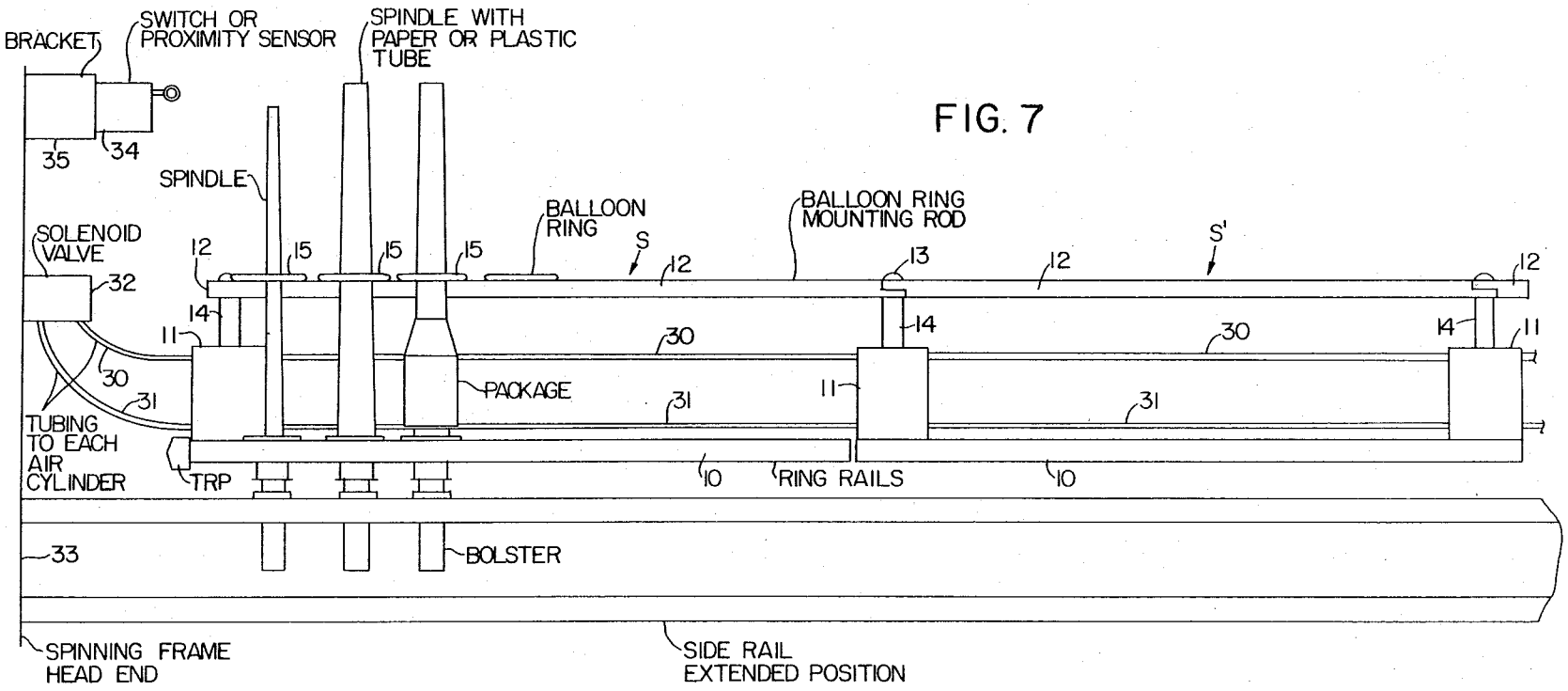
FIG. 7 is a schematic front elevation, with parts broken away, of two representative sections of a spinning frame equipped with the pneumatically operable balloon rings of this invention, and illustrating extension of the pistons in the air cylinders to fix the position of the balloon rings relative to the ring rail for optimum control of the balloon during the lower portion of the traverse.

The mounting rods 12 support brackets 16 which, in turn, support a plurality of balloon rings 15 in a substantially common plane between adjacent air cylinders 11 (FIG. 7).

Figure 1:
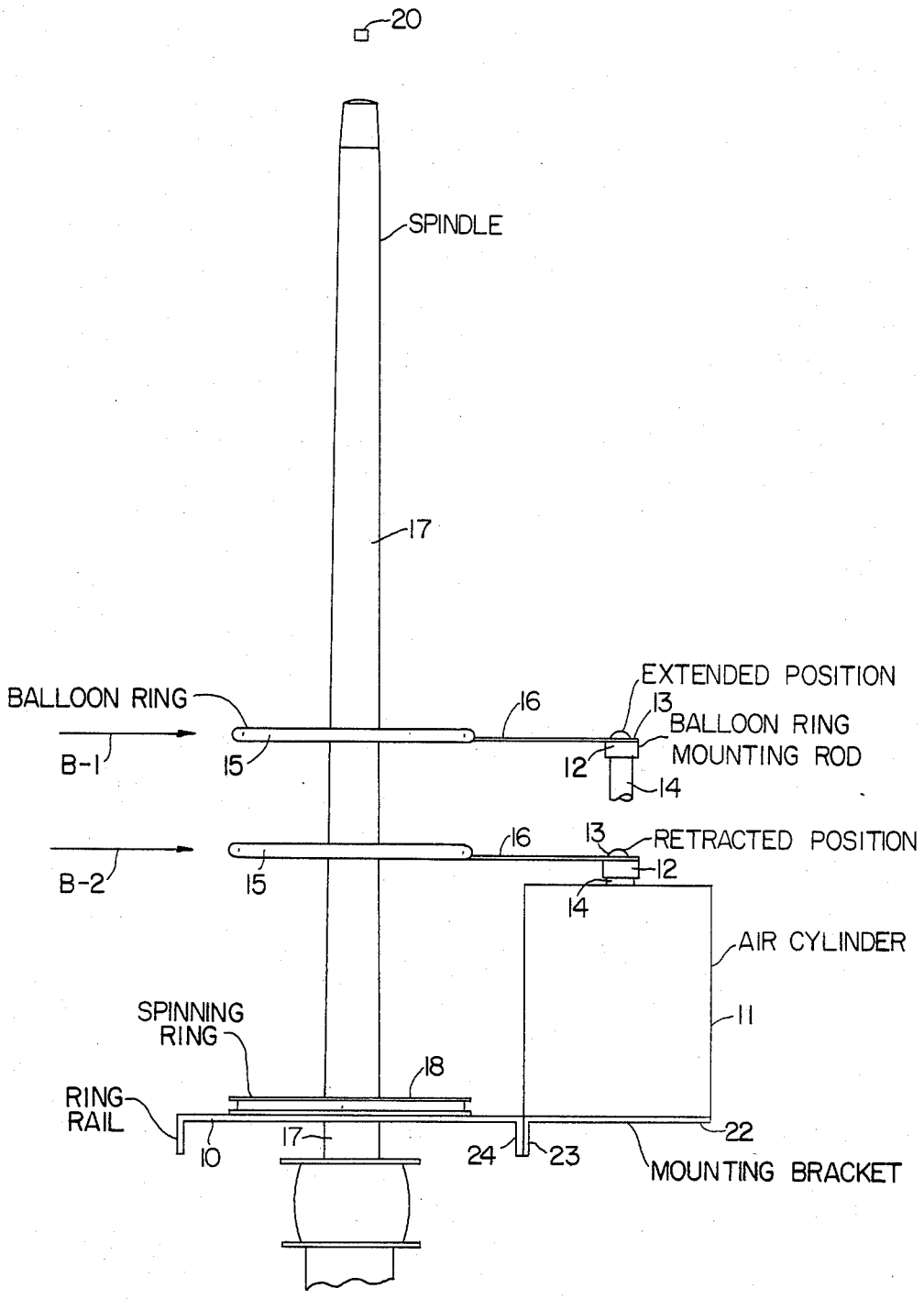
FIG. 1 is a schematic elevation of a station on a spinning frame equipped with one of the pneumatically operable balloon rings of this invention and illustrating the two operative positions of the rings for balloon control.

Referring to FIG. 1, a spindle 17 penetrates the longitudinally extending ring rail 10 and a spinning ring 18 surrounds the spindle and has a traveler, not shown, for guiding yarn onto a tube 19 placed over the spindle 10 for a winding operation.

The winding operation is commenced by directing an end of yarn Y from a source of supply, not shown, through a thread guide 20 above the spindle, along the tube 19, through a traveler, not shown, on the ring 18 and fixing it near the lower end of the tube 19. Rotation is imparted to the spindle 17 and its tube 19 in the normal manner. The winding operation as thus far described is conventional.

The air cylinders 11 are supported beside the ring rail 10 by a mounting bracket 22 having a depending flange 23 fastened to a corresponding flange 24 of the ring rail 10 and movable therewith. The number of spindles between air cylinders will depend upon the size of the packages being built.

The air cylinders 11 are activated by compressed air extending through air lines or tubing 30 and 31 to each cylinder 11 (FIG. 7) from a source of compressed air, not shown. Flow of compressed air through the air lines 30 and 31 is controlled by a solenoid valve 32 fixed to the head end 33 of the spinning frame.

Compressed air is introduced through air line 31 to elevate the free ends 13 of pistons 14 and fix the balloon rings 15 at their first operative or extended position in the area of maximum ballooning while the ring rail moves through the lower portion of its traverses. The first operative position of the balloon control rings is indicated by the arrow B-1 in FIGS. 1, 2, and 3. The rings 15 remain in extended position B-1 relative to the ring rail while the ring rail moves through the lower portion of its traverses to build the first or lower part of the packages. Compressed air is introduced through the air line 30 to retract the free ends 13 of pistons 14 and fix the balloon rings 15 at their second operative position (indicated by the arrow B-2 in FIGS. 1, 4, 5, and 6) while the ring rail moves through the upper portion of its traverses to build the upper part of the package.

Figure 2:
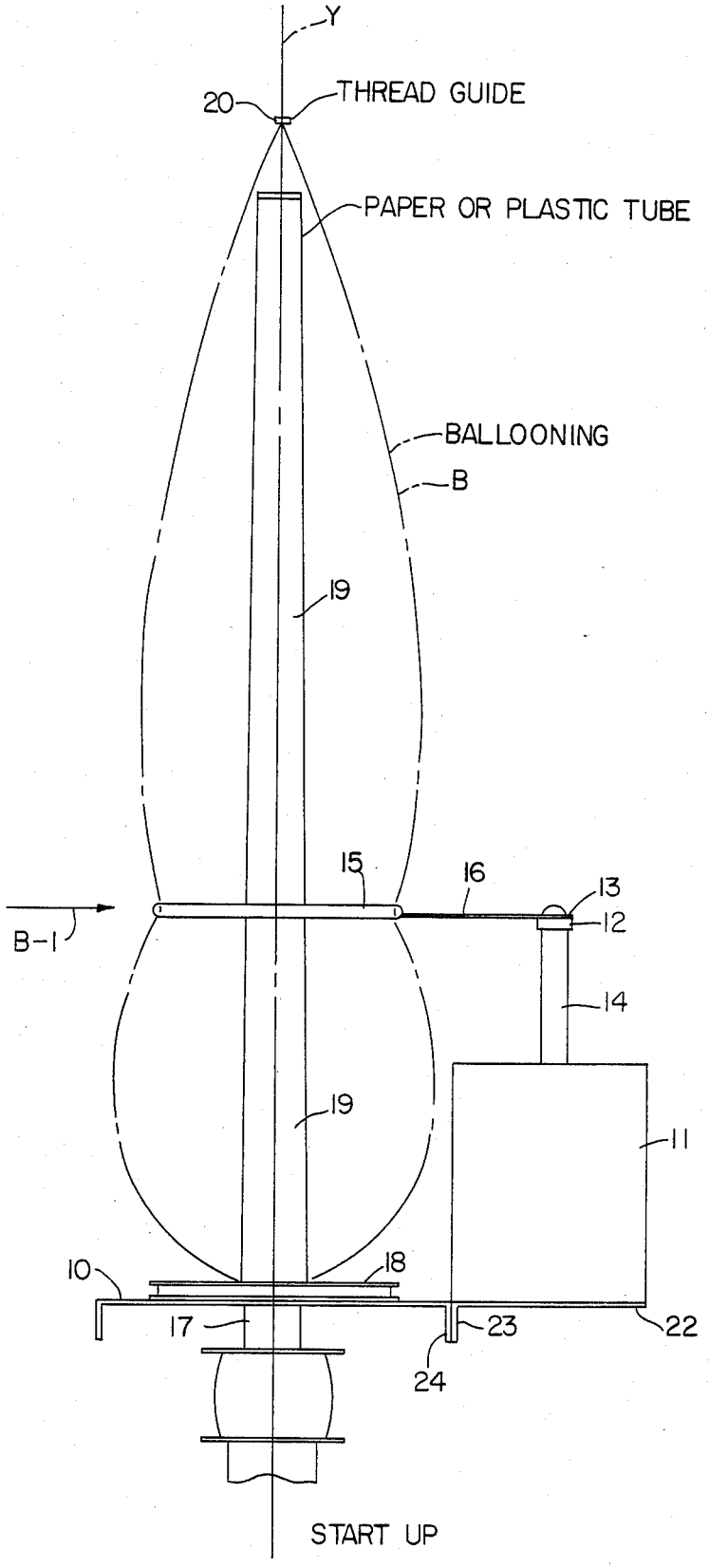
FIGS. 2 through 6, inclusive, are sequential schematic elevations of a single spinning station with the spindle equipped with a tube to form a yarn package and illustrating the advantages of the extended and retracted positions of the balloon ring during the lower and upper portions of the ring rail traverse.
Figure 3:
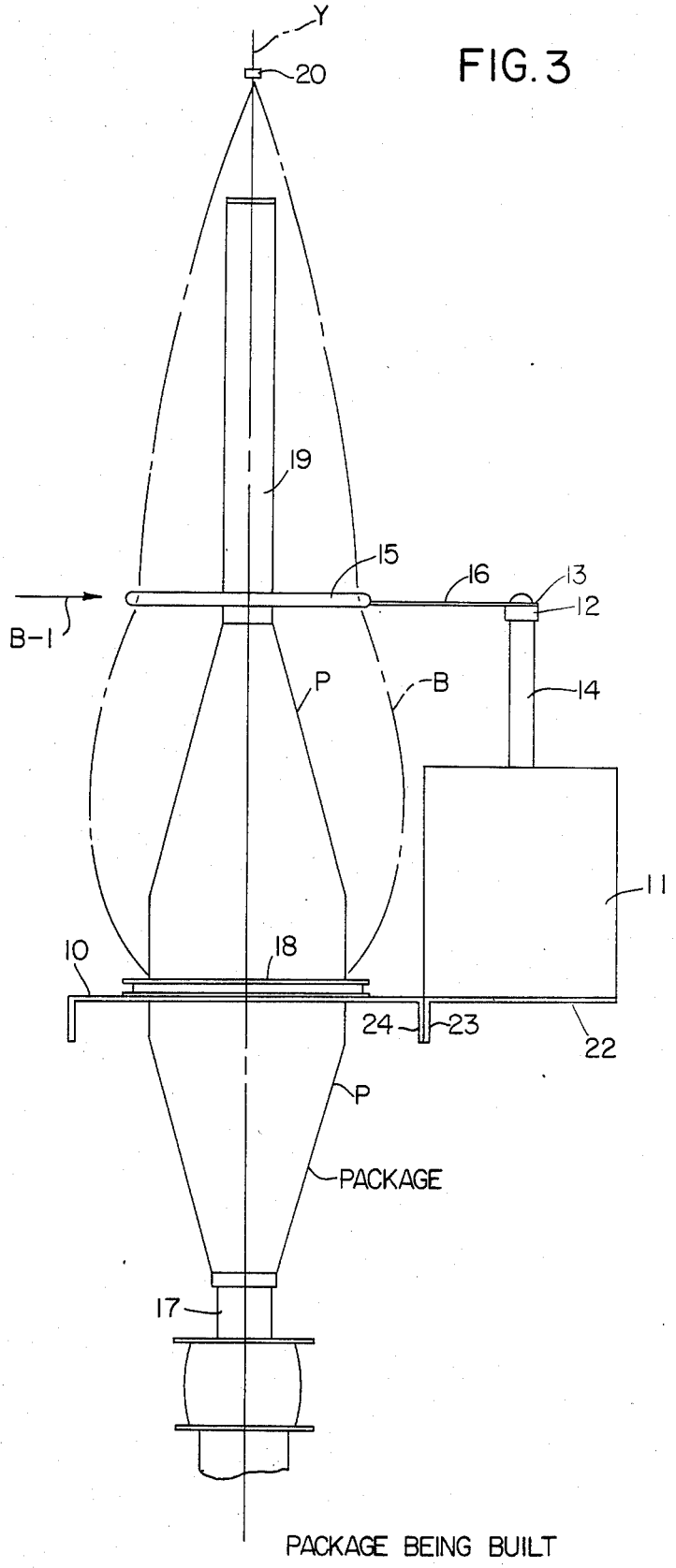

Referring to FIGS. 2 and 3, the balloon rings 15 are in their extended position B-1 while the ring rail makes the lower portion of its traverses following the start up of the winding operation.

The location B-1 has been determined from the fact that maximum ballooning of the yarn occurs at a point between 30% and 35% of the length of the tube as measured from its base, depending on the type of equipment being used and the type of cylinders 11 and the length of the pistons 14, in their extended position.

Figure 4:
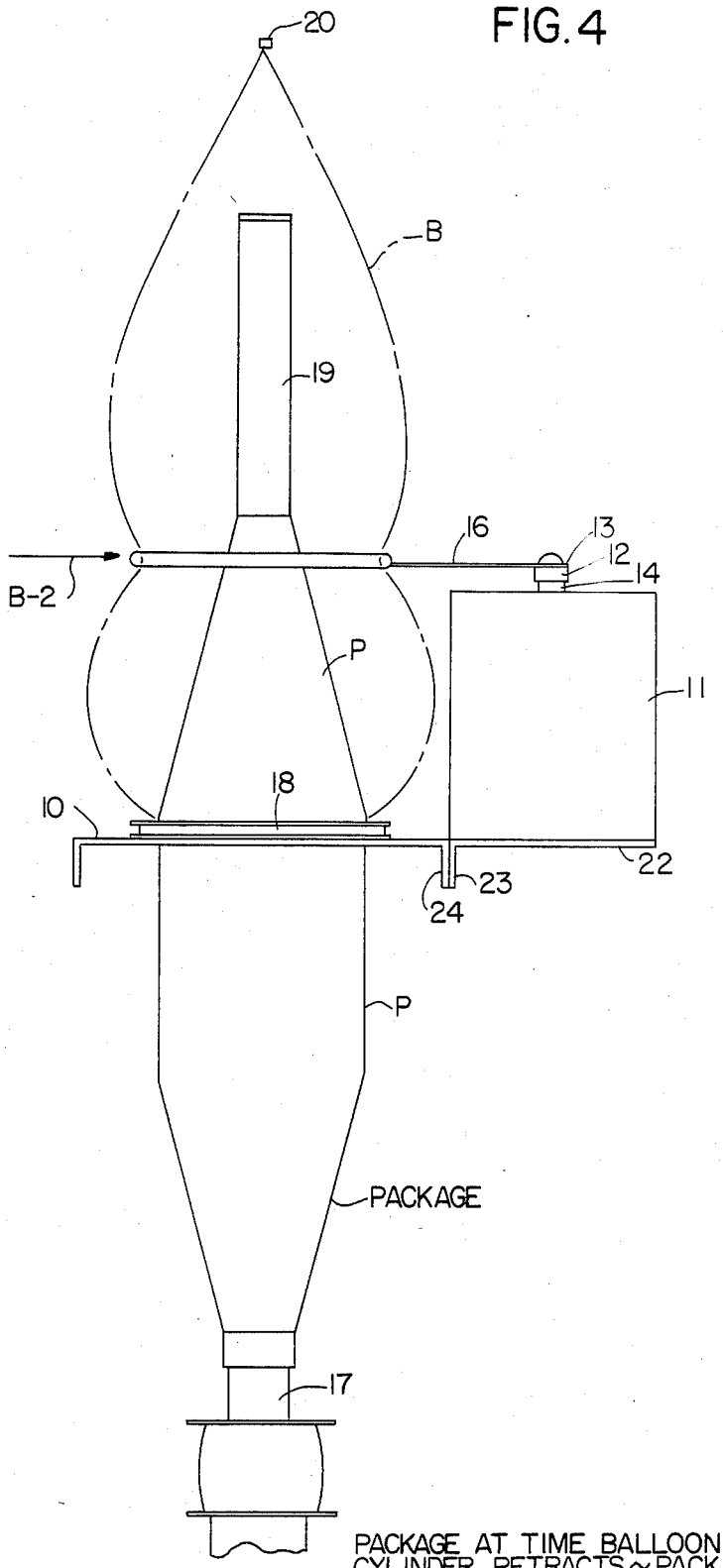

FIG. 4 shows the build-up of the package P after the ring rail has completed the lower portion of its traverses. As the ring rail first moves the balloon rings near the thread guides 20, the balloon control ring 15 around the spindle nearest the head end 33 contacts a sensing devise 34, such as a switch or proximity sensor extending inwardly from a bracket 35 attached to the head end 33. The sensing device 34 activates the solenoid 32 to simultaneously admit compresssed air through tube 30 to all of the air cylinders 11 and uniformly withdraw their respective pistons 14 and fix all of the balloon contol rings at their retracted or second operable position B-2. Position B-2 is calculated to be located in the area of maximum ballooning during formation of the upper half of the package. The balloon rings remain in their retracted position B-2 relative to the ring rail while it moves through the upper portion of of its traverses to complete the package.

Figure 5:
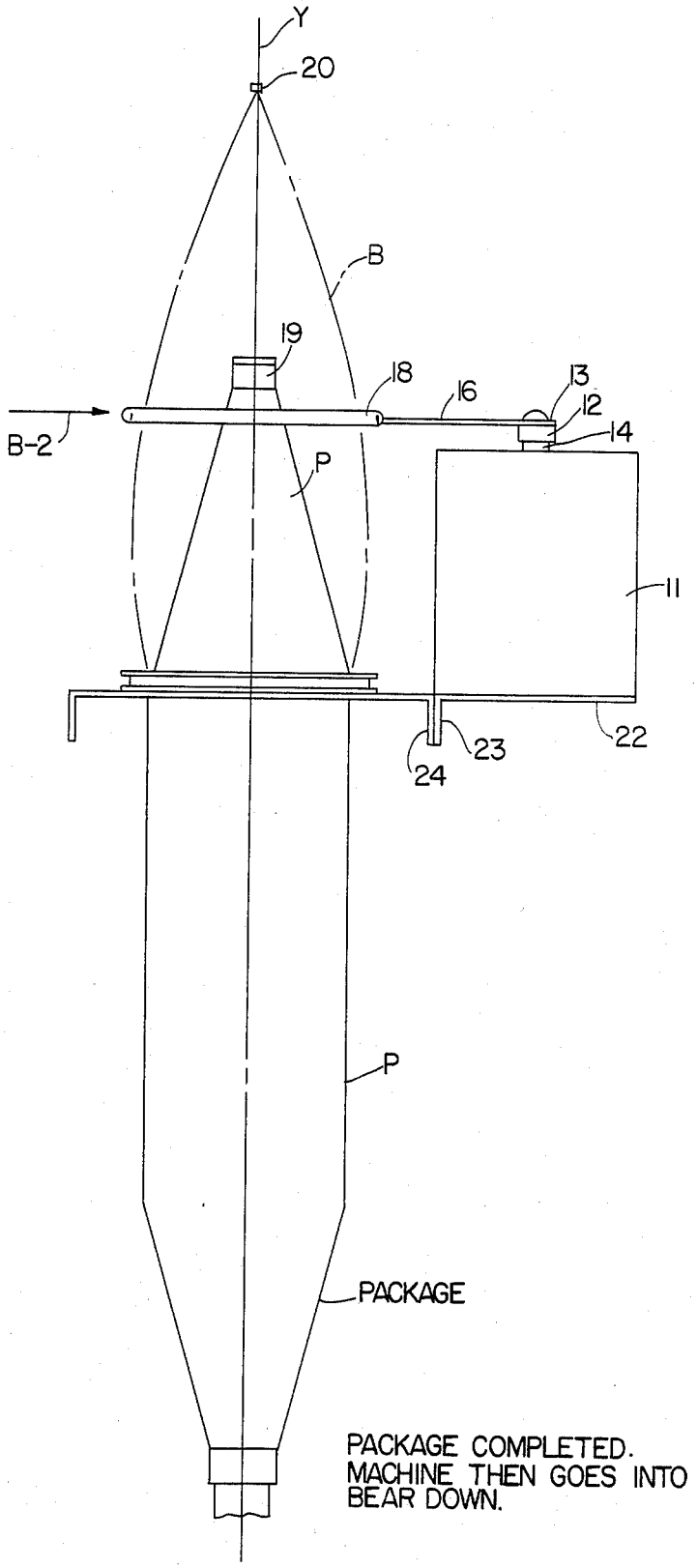

FIG. 5 shows the position B-2 of balloon control ring 15 to be an effective balloon controlling position as the package is being completed.

Figure 6:
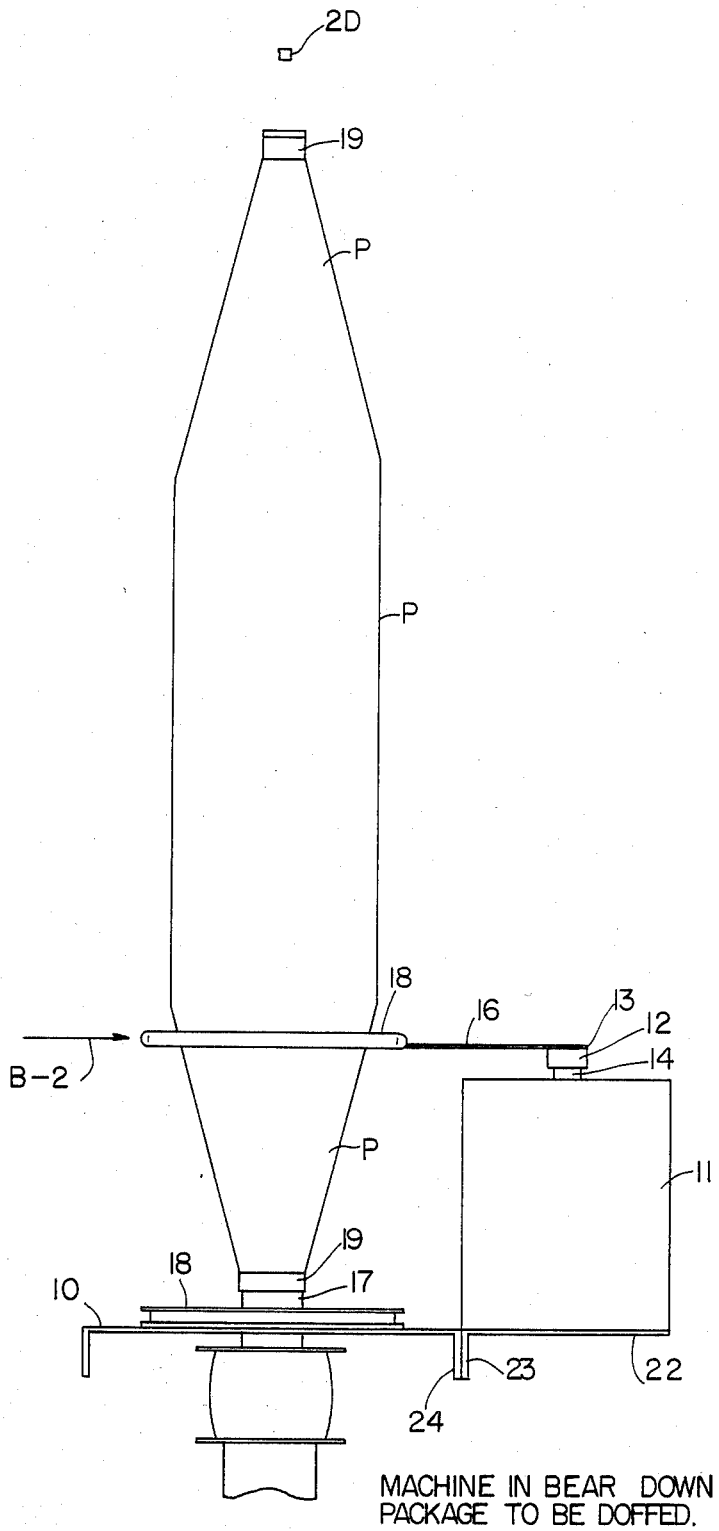

FIG. 6 shows that the retracted position B-2 of the balloon rings 15 is low enough not to interfere with doffing when the ring rail 10 is moved to bear down position.

The pistons 14 are elevated to return the balloon rings 15 to the extended position B-1 of FIG. 2 when it is desired to resume operations.

The movement of the balloon control rings 15 corresponds with movement of the ring rail throughout the complete building of the package, except for the retraction of the balloon rings from the extended B-1 position to the retracted position B-2 when the ring rail begins the upper portion of its traversing to form the upper half of the package.

One advantage of the present invention is that all of the balloon control rings on the spinning frame are uniformly maintained at their extended position B-1 in the area of maximum ballooning during the building of the lower half of the package, and all of the balloon control rings on the spinning frame are uniformly maintained at their retracted position B-2 in the area of maximum ballooning during the building of the upper half of the package. The advantages of uniformity, such as tension control and increased production are well known to those skilled in the art.

Although specific terms have been used in describing the invention, they are used in their generic sense only and not for purposes of limitation.

I claim:

1. Apparatus for the control of yarn ballooning while a yarn package is being formed on a rotating spindle by a vertically traversing ring rail movable successively through the lower and upper portions of its traverse, said apparatus comprising a balloon control ring encircling the spindle, means locating the ballon control ring at a first position spaced above the ring rail, means maintaining the balloon control ring at said first position for movement with the ring rail during the lower portion of its traverse, means locating the balloon control ring at a second position closer to the ring rail as the ring rail begins the upper portion of its traverse, and means maintaining the balloon control ring at said second position for movement with the ring rail during the upper portion of its traverse.

2. A structure according to claim 1 wherein said apparatus is a pneumatic system.

3. Apparatus according to claim 1 wherein a plurality of packages are being formed on a plurality of spindles and a separate balloon control ring encircles each spindle and wherein said means for locating the balloon control ring at said first position uniformly locates all of the balloon control rings at corresponding first positions, said means for maintaining the balloon control ring at said first position uniformly maintains all of the balloon control rings at said first position, said means for locating the balloon control ring at said second position uniformly locates all of the balloon control rings at corresponding second positions, and said means for maintaining the balloon control ring at said second position uniformly maintains all of the balloon control rings at their corresponding second positions.

4. A structure according to claim 3 wherein said apparatus is a pneumatic system.

5. Apparatus according to claim 1 which includes means for sensing a preselected position of the ring rail preparatory to locating the balloon control ring at said second position.

6. A pneumatic system for controlling the ballooning of yarn while being wound on a plurality of rotatable spindles, a balloon control ring encircling each spindle and a vertically traversing ring rail delivering yarn to the spindles from a source of yarn while moving through the lower and upper portions of its traverse, said pneumatic system comprising a plurality of air cylinders, means attaching the air cylinders to the ring rail for movement therewith, each air cylinder including a piston having a free end extending from the air cylinder, means connecting the balloon control rings to said free ends of the pistons, a source of air, means for simultaneously delivering air to at least some of the air cylinders to extend the free ends of the pistons and their respective balloon control rings to a first position spaced above the ring rail, means for maintaining the control rings in said first position during movement of the ring rail through the lower portion of the traverse, means for simultaneously moving the free ends of the pistons and their respective balloon control rings to a second position closer to the ring rail than said first position as the ring rail begins the upper portion of the traverse, and means for maintaining the control rings in said second position during movement of the ring rail through the upper portion of its traverse.

7. A pneumatic system according to claim 6 wherein said fixed upper position and said fixed lower position locate the balloon control rings in the area of about 30% to 35% of the length of the spindle tubes as measured from their base.

8. A pneumatic system for controlling the ballooning of yarn according to claim 6 which includes actuating means responsive to a selected position of the ring rail to initiate said means for simultaneously retracting the free ends of the piston.

9. A pneumatic system according to claim 6 wherein said means connecting the balloon control rings to the free ends of the pistons comprise mounting rods extending between the free ends of adjacent pistons and a group of brackets extending perpendicularly from each mounting rod and each bracket connecting a balloon control ring to the mounting rod.

10. A method of controllin the ballooning of yarn while it is being formed into packages on rotating spindles by a traversing ring rail, said method comprising the steps of:

(a) providing a balloon control ring for each spindle,
(b) supporting the balloon control rings on the ring rail with each balloon control ring encircling a spindle supported on the ring rail,
(c) locating the balloon control rings at a first position above the ring rail during the lower portion of the traverse,
(d) maintaining the balloon control rings at said first position for movement with the ring rail during the lower portion of the traverse,
(e) sensing a preselected position of the ring rail near the beginning of the upper portion of its traverse,
(f) then locating the balloon control rings at a second position closer to the ring rail, and
(g) maintaining the balloon control rings at said second position for movement with the ring rail during the upper portion of the traverse.

* * * * *